US007861358B2

(12) United States Patent
Moser et al.

(10) Patent No.: US 7,861,358 B2
(45) Date of Patent: Jan. 4, 2011

(54) HAND TOWEL WITH ATTACHED SCRUBBER

(76) Inventors: Chadd Moser, 5940 Newton Ave. South, Minneapolis, MN (US) 55419; Ryan M. Utecht, 868 Sherwood Ave., St. Paul, MN (US) 55106

( * ) Notice: Subject to any disclaimer, the term of this patent is extended or adjusted under 35 U.S.C. 154(b) by 62 days.

(21) Appl. No.: 11/891,318

(22) Filed: Aug. 9, 2007

(65) Prior Publication Data

US 2008/0263799 A1 Oct. 30, 2008

Related U.S. Application Data

(60) Provisional application No. 60/836,800, filed on Aug. 10, 2006.

(51) Int. Cl.
*A47L 13/12* (2006.01)

(52) U.S. Cl. ..... 15/118; 15/209.1

(58) Field of Classification Search ..... 15/114, 15/118, 209.1
See application file for complete search history.

(56) References Cited

U.S. PATENT DOCUMENTS

| | | | | |
|---|---|---|---|---|
| 1,495,389 | A | | 5/1924 | Heimerel et al. |
| 1,519,577 | A | | 12/1924 | Easton, Jr. |
| 2,022,199 | A | | 11/1935 | Heinrich |
| 2,665,528 | A | | 1/1954 | Sternfield et al. |
| 2,778,044 | A | * | 1/1957 | Mikulski ..... 401/23 |
| 2,910,710 | A | * | 11/1959 | Corrington et al. ..... 15/118 |
| 3,226,751 | A | | 1/1966 | Lemelson |
| 3,293,683 | A | | 12/1966 | Wyant |
| 3,414,928 | A | | 12/1968 | Lemelson |
| 3,634,901 | A | | 1/1972 | Landsberg |
| 3,641,719 | A | | 2/1972 | Yang |
| 3,664,064 | A | | 5/1972 | Scheuer |
| 4,027,352 | A | | 6/1977 | Wagner |
| 4,104,435 | A | | 8/1978 | Ballesteros |
| 4,142,334 | A | | 3/1979 | Kirsch et al. |
| 4,462,135 | A | | 7/1984 | Sanford |
| 4,510,641 | A | | 4/1985 | Morris |
| 4,525,411 | A | | 6/1985 | Schmidt |
| 4,665,580 | A | | 5/1987 | Morris |
| 4,912,800 | A | * | 4/1990 | Zeltner ..... 15/114 |
| 5,075,918 | A | * | 12/1991 | Zeltner et al. ..... 15/210.1 |
| 5,331,705 | A | * | 7/1994 | Melov ..... 15/118 |
| 5,761,761 | A | * | 6/1998 | An ..... 15/209.1 |
| 5,955,417 | A | | 9/1999 | Taylor |
| 6,098,234 | A | | 8/2000 | Jackson, Jr. |
| 6,180,035 | B1 | | 1/2001 | Hsieh et al. |
| 6,258,455 | B1 | | 7/2001 | Clarke |
| 6,491,937 | B1 | | 12/2002 | Slavtcheff et al. |
| 6,644,881 | B1 | | 11/2003 | Dawan |
| 6,694,563 | B2 | | 2/2004 | Onwugbonu |
| 7,044,173 | B2 | | 5/2006 | Silver |
| 2003/0233717 | A1 | * | 12/2003 | Ortega et al. ..... 15/118 |

* cited by examiner

*Primary Examiner*—Mark Spisich
(74) *Attorney, Agent, or Firm*—Merchant & Gould P.C.

(57) ABSTRACT

The disclosure provides a cleaning device and a method of manufacturing the same. The cleaning device is configured to be effectively used for cleaning, polishing, drying, scrubbing, and scouring. The cleaning device is constructed of a combination of materials wherein the different component materials are inherently better suited for different functions. The component materials are sized, arranged, and combined to provide a highly effective and versatile cleaning tool.

28 Claims, 3 Drawing Sheets

HAND TOWEL WITH ATTACHED SCRUBBER

CROSS REFERENCE TO RELATED APPLICATIONS

This application claims the benefit of U.S. Provisional Patent Application Ser. No. 60/836,800, filed Aug. 10, 2006, which application is hereby incorporated by reference in its entirety.

FIELD OF THE INVENTION

The present invention relates to a cleaning apparatus and, more particularly, to a dish cloth with an attached scrubber.

BACKGROUND OF THE INVENTION

Natural sponges and synthetic sponges have been used for washing or cleaning purposes due to their ability to hold water, soap emulsions, and detergents. Synthetic sponges are more commonly used due to the limited supply of natural sponges. Synthetic sponges are commonly formed of foamed synthetic or cellulose resins, such as polyurethane foams.

A common problem with sponges is that they tend to wear relatively rapidly and are easily broken or torn. Increasing the strength of synthetic sponges has been attempted by varying the foamed composition and the dimensions of the open cells. Wear problems remain, however, and even the best sponges deteriorate, especially when they are used for scrubbing or scouring. Fibrous abrasive pads, which are more effective for scrubbing or scouring but do not have the desirable sponge characteristics identified above, have been combined with sponges. Where sponge and abrasive pads are combined, the sponge portion absorbs and holds water and cleaning materials, and the fiber cloth provides an abrasive scouring pad, but each has an independently useful life.

Though the sponge and scouring pad arrangement has its advantages, such combinations are not typically as effective for polishing, drying, and cleaning in crevices as hand towels. Cloth hand towels are made of a wide variety of materials. Recently, cloth hand towels made of soft materials such as microfibers have become a popular choice for cleaning, drying, and polishing (microfibers are fibers with strands thinner than one denier, making these fibers even finer than silk).

There is a need in the art for a cleaning device that has the advantages of a soft towel as well as the advantages of scouring and scrubbing pads.

SUMMARY OF THE INVENTION

The present invention relates to a cleaning device and a method of manufacturing the same. The device according to the present disclosure is configured to be effectively used for cleaning, polishing, drying, scrubbing, and scouring. The cleaning device is constructed of a combination of materials wherein the different component materials are inherently better suited for different functions. The component materials are sized, arranged, and combined to provide a highly effective and versatile cleaning tool.

Advantages associated with some embodiments of the device according to the present disclosure include, but are not limited to, the ability to effectively clean with water alone, thereby helping to eliminate the need for harmful chemical cleaners and making this an environmentally friendly hypoallergenic cleaning tool; the ability of the device to lift and trap dirt particles and moisture far faster than prior art devices; the quick drying properties (e.g., some embodiments dry 10× faster than standard scouring devices); ultra strong and soft properties (e.g., some embodiments are 2× softer than silk and 3× softer than cotton); and the super absorbent properties (e.g., some embodiments hold 7× its weight in liquid, dust or dirt).

DETAILED DESCRIPTION OF THE PREFERRED EMBODIMENT

Figure 1:
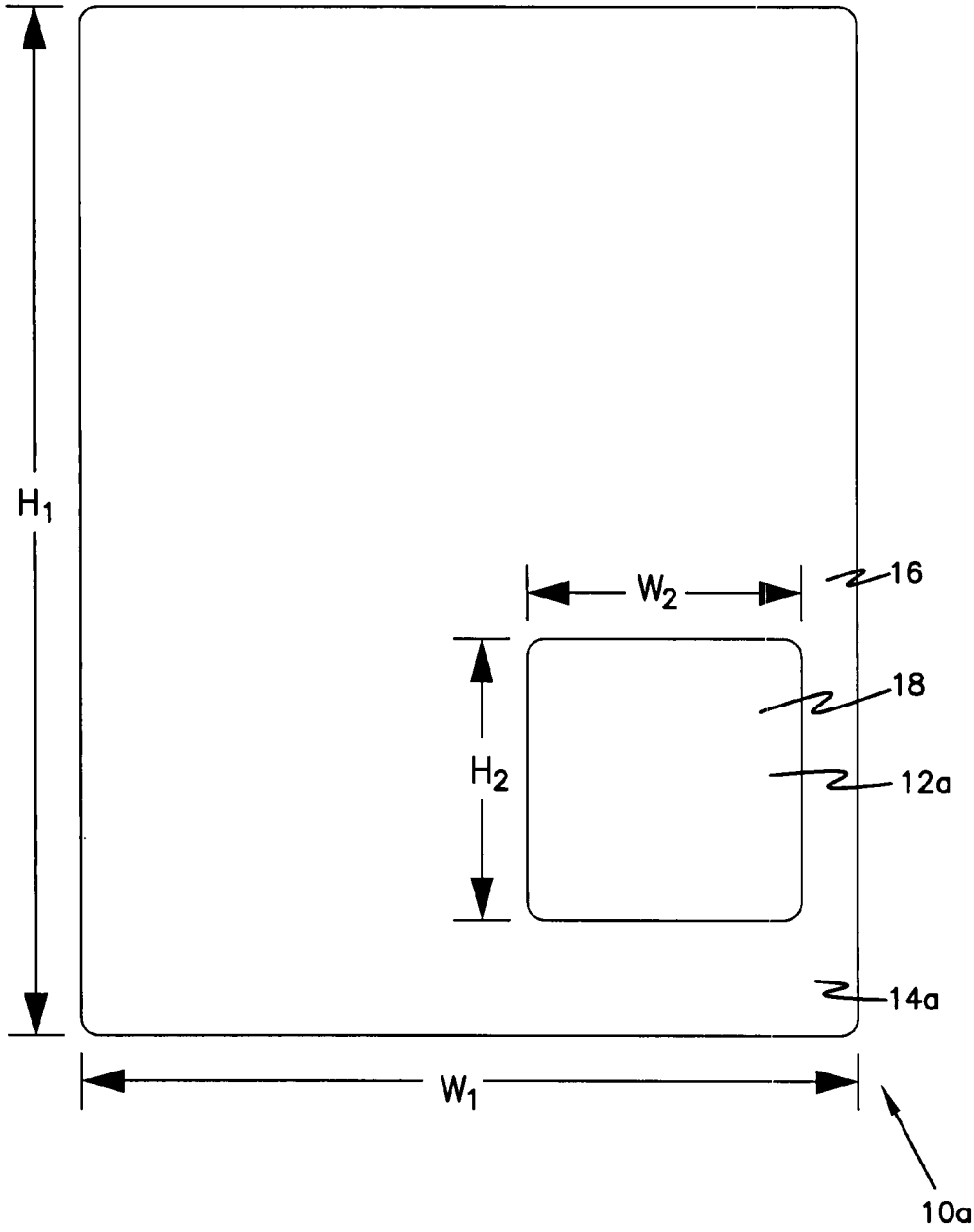
FIG. 1 is a front view of the cleaning towel according to a first embodiment of the present disclosure.

Referring to FIG. 1, the towel 10*a* includes a cloth portion 14*a* and an abrasive portion 12*a*. The cloth portion 14*a* comprises a material that is suitable for absorbing liquids (drying), cleaning, and polishing. Cloth as used herein refers generally to a pliable material usually made by weaving, felting, or knitting natural or synthetic fibers and filaments or something with like physical properties. In the depicted embodiment the cloth is of the microfiber type. The particular type of microfiber in the depicted embodiment is a blend of microscopic polyester and polyamide fiber which is split and then woven into hooks and loops to create tiny scoops that attract particles and absorb liquid. Example microfiber patents include U.S. Pat. No. 7,044,173 titled Microfiber Towel with Cotton Base; U.S. Pat. No. 6,258,455 titled Antimicrobial Ultra-microfiber Cloth; and U.S. Pat. No. 4,525,411 titled Cleaning Cloth, which are all herein incorporated in their entirety by reference. It should be appreciated that in other embodiments the cloth portion 14*a* may be of another type, for example, a cotton material, an organic cotton material, bamboo, or other materials. The abrasive portion 12*a* comprises a material that is better suitable for scrubbing and scouring than the cloth portion. In the depicted embodiment the abrasive portion 14*a* is made of a polyethylene nylon blend. Example scrubbing pad patents include U.S. Pat. No. 6,180,035 titled Scouring Pad Fabricating Method and U.S. Pat. No. 5,955,417 titled Scouring Pad, which are both herein incorporated in their entirety by reference. Nonetheless, it should be appreciated that the abrasive portion 14*a* in other embodiments may comprise other types of materials, for example, a loofah material. In certain embodiments, the abrasive portion 12*a* is an abrasive pad including a plurality of fibers/filaments and an abrasive material added to the fibers/filaments of the pad. Examples of such abrasive material include aluminum oxide, pumice, silica and silica compounds.

The towel 10*a* is rectangular (a shape having one or more right angles), but it should be appreciated that many other shapes are also possible including, for example, circular, oval, triangular, or irregular shapes. In the depicted embodiment the towel 10*a* has a height $H_1$ of approximately 10-14 inches and a width $W_1$ of approximately 10-14 inches (e.g., 11×8.5 or 12×12). Preferably, the towel 10*a* according to this disclosure has a cross-sectional area of between 36 square inches and 250 square inches. More preferably, the towel 10*a* has a cross-sectional area of between 70 to 150 square inches.

In the depicted embodiment the abrasive portion 12*a* is square shaped with a height $H_2$ and width $W_2$ of approximately 3 inches. It should be appreciated that the abrasive portion can be of many other shapes and sizes. In preferred embodiments the abrasive portion 12*a* has an area 4 to 25 square inches. In more preferred embodiments the area of the abrasive portion is less than 20 percent of the area of the towel. The size of the abrasive portion 12*a* can have an effect on the overall effectiveness of the towel 10*a*. If the abrasive portion is too small, the towel may not be as effective for scrubbing and scouring. On the other hand if the abrasive portion is too large, the towel may not be as effective for drying and polishing.

In the depicted embodiment the abrasive portion 12*a* is roughly centered in the lower right quadrant 16 of the towel 10*a*. The arrangement prevents the abrasive portion 12*a* from interfering with the cloth portion 14*a* while the towel 10*a* is in use. According to the depicted arrangement the towel 10*a* can be conveniently folded to position abrasive portion 12*a* inside the towel 10*a*, which prevents the abrasive portion 12*a* from inadvertent contact with the object that is being cleaned, polished, or dried. However, it should be appreciated that the abrasive portion 12*a* could be positioned at other locations as well while still enabling the towel 10*a* to be selectively used as a cloth only.

Still referring to FIG. 1, the abrasive portion 12*a* is shown as an abrasive pad 18 that is stitched and bound over the cloth portion 14*a* of the towel 10*a*. In the depicted embodiment only one side of the towel 10*a* includes an abrasive portion 12*a*. According to the depicted construction the cloth portion 14*a* provides structural support for abrasive portion 12*a*. In the depicted embodiment only one surface of the towel 10*a* has an abrasive portion 12*a*. It should be appreciated that in alternative embodiments an abrasive pad 18 may be stitched to both sides of the towel 10*a* so that both sides of the towel 10*a* include abrasive portions 12*a*. Also, in alternative embodiments the cloth portion could be cut away or otherwise absent in the abrasive portion 12*a* such that the abrasive pad 18 is exposed on both sides of the towel 10*a*.

Figure 2:
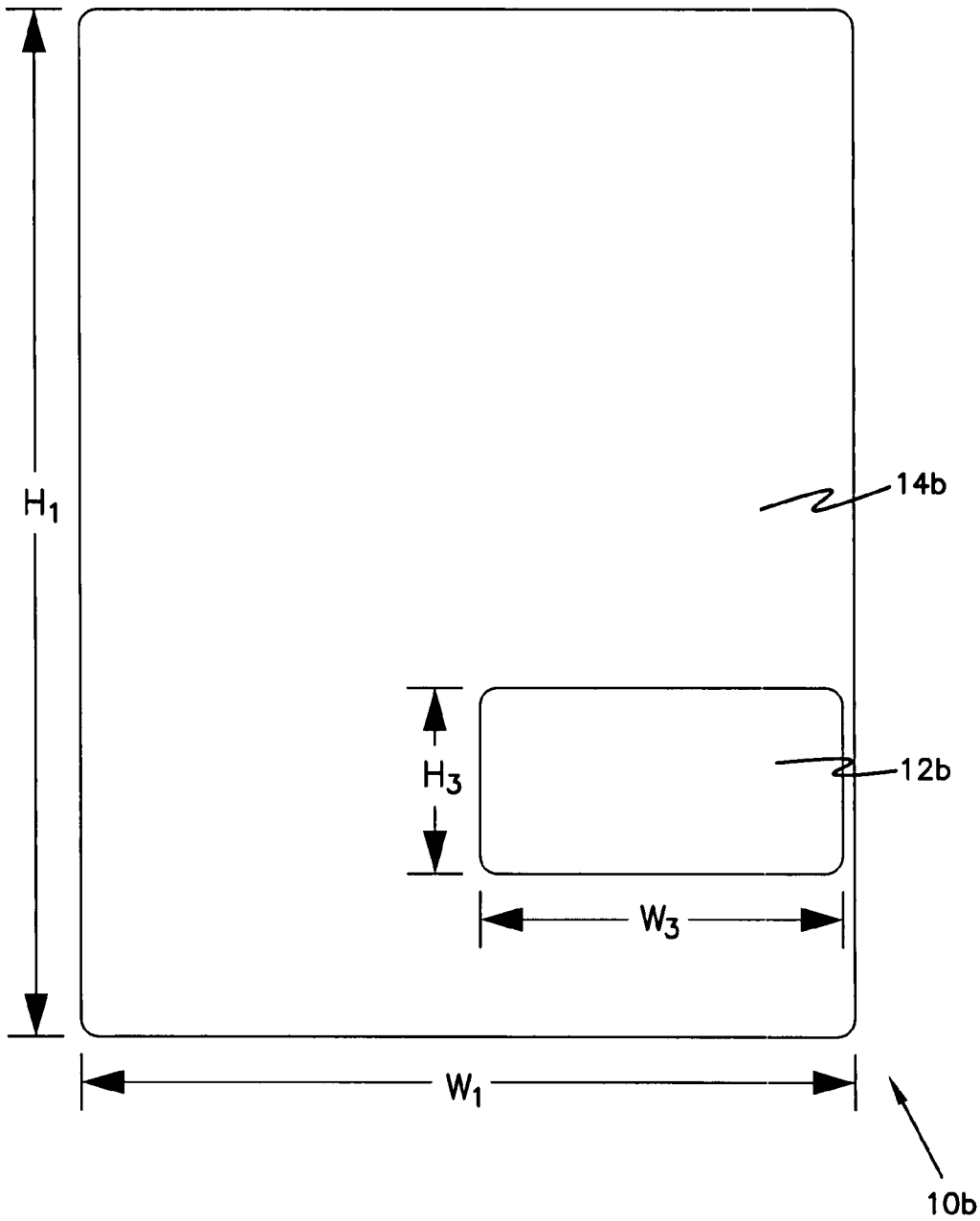
FIG. 2 is a front view of the cleaning towel according to a second embodiment of the present disclosure.

Referring to FIG. 2, a second embodiment of the towel 10*a* is shown. The towel 10*b* includes an identical cloth portion 14*b* and similar abrasive portion 12*b*. The abrasive portion 12*b* is rectangular rather than square shaped. It includes a height $H_3$ of approximately 2 inches and a width $W_3$ of approximately 4 inches.

Figure 3:
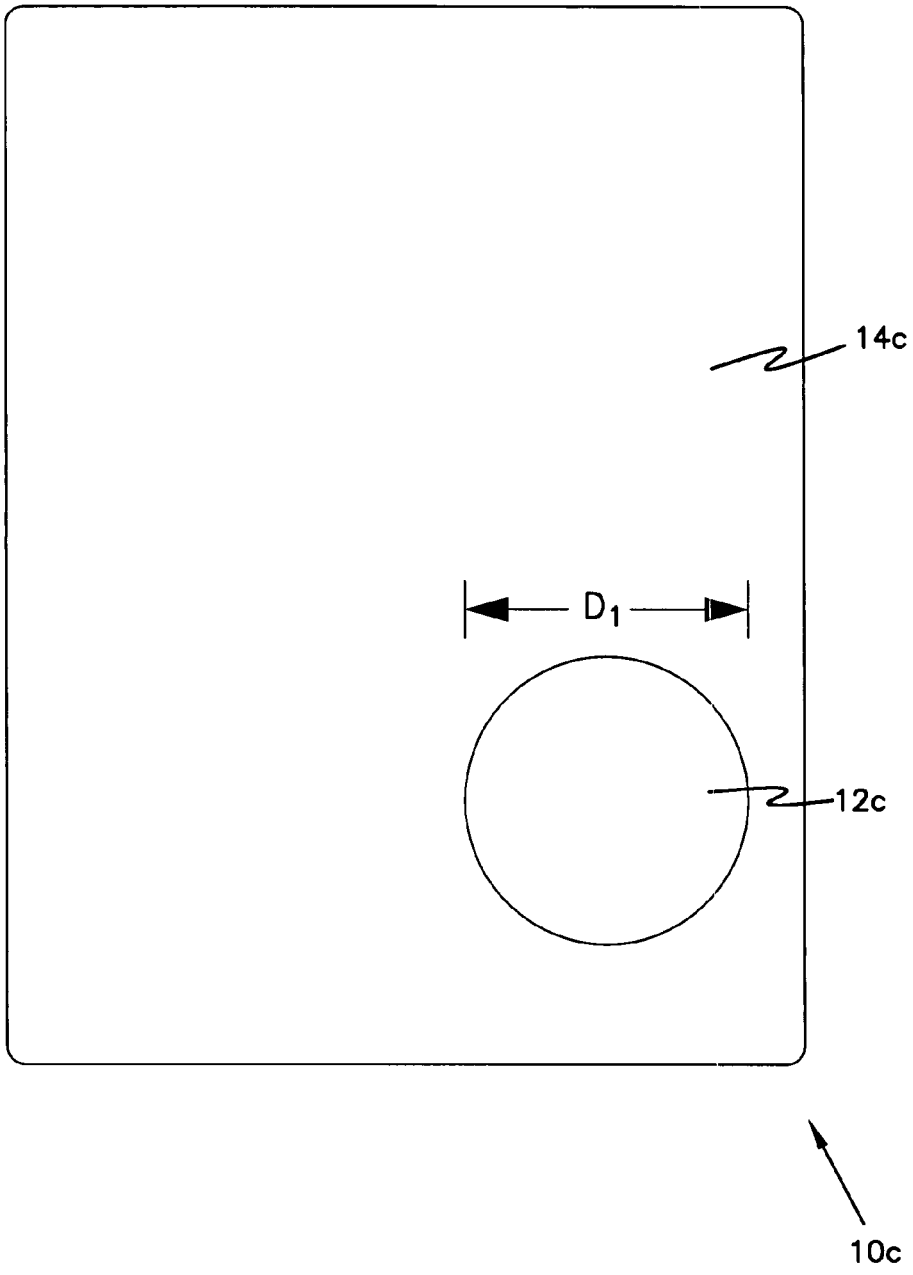
FIG. 3 is a front view of the cleaning towel according to a third embodiment of the present disclosure.

Referring to FIG. 3, a third embodiment of the towel 10*a* is shown. The towel 10*c* includes an identical cloth portion 14*c* and similar abrasive portion 12*c*. The abrasive portion 12*c* is circular rather than square or rectangular shaped. It includes a diameter $D_1$ of approximately 3 inches. The second and third embodiments are further examples of towels that include a first material and a second material, wherein the first material is better suited for drying and polishing and the second material is better suited for scrubbing and cleaning. The second material and the first material in both embodiments are arranged relative to each other such that both materials can be used for their respective functions without interference of the other.

The above specification provides examples of how certain inventive aspects may be put into practice. It will be appreciated that the inventive aspects can be practiced in other ways than those specifically shown and described herein without departing from the spirit and scope of the inventive aspects. In the description, like reference numbers have been used to identify like or similar parts.

We claim:

1. A device comprising:

an abrading and absorbing structure including a front side and a back side;

the abrading and absorbing structure including a cloth defining a perimeter edge of the abrading and absorbing structure, the cloth defining a first quadrant, a second quadrant, a third quadrant and a fourth quadrant, the first quadrant of the cloth defining a first quadrant area, the cloth having an absorbent construction, the cloth having a front side and a back side, and the perimeter edge of the abrading and absorbing structure defining a shape having four sides with each of the sides having a length in the range of 10-14 inches;

an abrasive pad positioned at the front side of the abrading and absorbing structure, the abrasive pad having a construction that has better scrubbing and scouring characteristics as compared to the cloth, the abrasive pad including a plurality of fibers and an abrasive material added to the fibers of the pad, the abrasive pad being stitched to front side of the cloth at the first quadrant of the cloth, the abrasive pad having a shape selected from the group consisting of a square, a rectangle and a circle, the abrasive pad defining an abrasive area that is smaller than the first quadrant area, the abrasive pad being inwardly offset from the perimeter edge of the abrading and absorbing structure, and the abrasive pad being positioned entirely within the first quadrant of the cloth;

the back side of the abrading and absorbing structure being defined by the back side of the cloth, the back side of the cloth having the absorbent construction, and the back side of the abrading and absorbing structure not including any abrasive portions; and the front side of the abrading and absorbing structure being defined by the abrasive pad and a remainder of the front side of the cloth that is not covered by the abrasive pad, the remainder of the front side of the cloth having the absorbent construction.

2. The device of claim 1, wherein the cloth is a pliable material made of fibers.

3. The device of claim 2, wherein the cloth is of the microfiber type.

4. The device of claim 3, wherein the microfiber is a blend of woven polyester and polyamide fibers.

5. The device of claim 1, wherein the abrasive pad includes a polyethylene nylon blend material.

6. The device of claim 1, wherein the abrasive pad is square shaped with a height and width of about 3 inches.

7. The device of claim 1, wherein the abrasive pad is rectangular and includes a height of about 2 inches and a width of about 4 inches.

8. The device of claim 1, wherein the abrasive pad is circular and includes a diameter of about 3 inches.

9. The device of claim 1, wherein the abrasive pad is less than 20 percent of the area of the device.

10. The device of claim 1, wherein the abrasive pad is sized and arranged such that the abrasive pad can be folded inside the cloth.

11. A method of cleaning and polishing an item with the device of claim 1, the method comprising:

exposing the abrasive pad of the device and moving the abrasive pad across a surface of the item to clean the item; and enclosing the abrasive pad within the cloth of the device and moving the cloth across the surface of the item to polish the item.

12. The device of claim 1, wherein the front and back sides of the cloth both have a microfiber construction.

13. The device of claim 12, wherein the microfiber construction is a blend of woven polyester and polyamide fibers.

14. The device of claim 1, wherein the front and back sides of the cloth both include a material selected from a group consisting essentially of inorganic cotton, organic cotton, and bamboo.

15. The device of claim 1, wherein the abrasive pad is circular in shape.

16. The device of claim 1, wherein the abrasive pad is square in shape.

17. The device of claim 1, wherein the abrasive pad is square in shape with rounded corners.

18. The device of claim 1, wherein the abrasive pad is rectangular in shape.

19. The device of claim 1, wherein the abrasive pad is rectangular in shape with rounded corners.

20. The device of claim 1, wherein the perimeter edge of the abrading and absorbing structure defines an area in the range of 70 to 150 square inches.

21. The device of claim 1, wherein the abrasive material is selected from the group consisting of aluminum oxide, pumice, silica and silica compounds.

22. The device of claim 1, wherein the fibers of the abrasive pad are non-woven.

23. The device of claim 1, wherein the shape defined by the perimeter edge of the abrading and absorbing structure is square.

24. The device of claim 23, wherein the perimeter edge of the abrading and absorbing structure defines an area in the range of 70 to 150 square inches.

25. The device of claim 23, wherein the square shape defined by the perimeter edge is 12 inches by 12 inches.

26. A device comprising:

an abrading and absorbing structure including a front side and a back side;

the abrading and absorbing structure including a cloth defining a perimeter edge of the abrading and absorbing structure, the cloth defining a first quadrant, a second quadrant, a third quadrant and a fourth quadrant, the first quadrant of the cloth defining a first quadrant area, the cloth having an absorbent construction, the cloth having a front side and a back side, and the perimeter edge of the abrading and absorbing structure defining a square shape defining an area in the range of 70 to 150 square inches;

an abrasive pad positioned at the front side of the abrading and absorbing structure, the abrasive pad having a construction that has better scrubbing and scouring characteristics as compared to the cloth, the abrasive pad including a plurality of fibers and an abrasive material added to the fibers of the pad, the abrasive pad being stitched to front side of the cloth at the first quadrant of the cloth, the abrasive pad having a rectangular shape with rounded corners, the abrasive pad defining an abrasive area that is smaller than the first quadrant area, the abrasive pad being inwardly offset from the perimeter edge of the abrading and absorbing structure, and the abrasive pad being positioned entirely within the first quadrant of the cloth;

the back side of the abrading and absorbing structure being defined by the back side of the cloth, the back side of the cloth having the absorbent construction; and the front side of the abrading and absorbing structure being defined by the abrasive pad and a remainder of the front side of the cloth that is not covered by the abrasive pad, the remainder of the front side of the cloth having the absorbent construction.

27. The device of claim 26, wherein the abrasive pad is square in shape with rounded corners.

28. The device of claim 27, wherein the square shape defined by the perimeter edge is 12 inches by 12 inches.

* * * * *